United States Patent [19]

Rossetti

[11] 4,377,244

[45] Mar. 22, 1983

[54] CONTAINER END AND CLOSURE THEREFOR

[75] Inventor: James J. Rossetti, Palmyra, Wis.

[73] Assignee: Lakeshore Commercial Finance Corporation, Milwaukee, Wis.

[21] Appl. No.: 321,756

[22] Filed: Nov. 16, 1981

[51] Int. Cl.[3] ..... B65D 41/32

[52] U.S. Cl. ..... 220/268

[58] Field of Search ..... 220/266–273

[56] References Cited

U.S. PATENT DOCUMENTS

| | | | |
|---|---|---|---|
| 4,202,461 | 5/1980 | Sinoto | 220/268 |
| 4,210,256 | 7/1980 | Amberg et al. | 220/268 |
| 4,252,247 | 2/1981 | Asbury | 220/268 |
| 4,319,692 | 3/1982 | Gundlach | 220/268 |

*Primary Examiner*—George T. Hall

*Attorney, Agent, or Firm*—Howard H. Darbo

[57] ABSTRACT

A metal container end which is shaped to be attached at its periphery to a container body, such as a soft drink or beer container. The container end has a sealed closure having an opening activator in the form of a button raised in the container end. A lid is formed in the container end adjacent to and attached to the activator, the lid being defined by a frangible score line extending along the marginal edges of the lid from either side of the juncture of the activator and lid. The juncture of the activator and lid includes a fulcrum operable such that application of downward pressure on the activator causes the lid to sever from the container end along the score line and pivot upwardly from the container end about the fulcrum. The lid can then be manually bent along the fulcrum until it is pivoted adjacent to and coextensive with the activator.

21 Claims, 16 Drawing Figures

CONTAINER END AND CLOSURE THEREFOR

BACKGROUND OF THE INVENTION

This invention relates to containers for liquids, and in particular to an integral closure for the container which is formed in the container end.

Beverage containers are typically provided with an opening means for removal of the container contents. A wide variety of closures for containers for the packaging of beer, soft drinks and other liquids have a portion of the lid which is torn away along score lines to open the container. To facilitate removal of the tear away portion, a separate tab is secured to the container lid at the point at which the tearing operation is to be initiated. The tab is lifted by a finger and used as a handle to remove the tear away portion. Any such known arrangement requires a two-part assembly.

Until recently, a widely used "pop-top" permitted and envisaged the complete removal of a portion of the lid to provide the opening. Because of the nuisance of disposal of the removed tab, many users simply drop the tab into the opened container. Not only does this practice introduce contaminants into the container, but also it may result in injury to those drinking directly from the can as a consequence of passage of the metal tab out of the container as the contents are being drunk by the user. As a consequence, the sale of containers having this popular form of closure has been prohibited in many jurisdictions and a more costly, non-removable pop-top design has been substituted. However, this design, in addition to being more costly, also is difficult to manipulate to open the container and it frequently malfunctions so that the container must be opened by other means.

Other pop-tops for containers have been developed. For example, U.S. Pat. No. 3,741,432 discloses a container having a closure tab and pressure release tab. Such tabs were previously utilized in beer containers sold in the latter part of the 1970's throughout the Western United States, but were discontinued due in part to considerable difficulties experienced by users in opening the containers. In addition, the closure is unsatisfactory since the closure must be bent inwardly into the container and is therefore a potential source of contamination.

Other closures have been developed for containers. For example, U.S. Pat. No. 3,843,011 discloses several embodiments of a closure for a container. However, each of the disclosed closures is complex (and therefore costly) and requires several steps in manufacture. U.S. Pat. No. 3,261,497 discloses a closure for a container having a folded-over portion which is hingedly secured to the top end of the container. Again, due to the complexity of the closure, its use is not feasible in light of manufacturing and assembly costs.

U.S. Pat. No. 3,958,717 discloses a container closure which is hinged to be bent downwardly into the interior of the container. Not only is the closure a potential source of contaminants for the container, but also since the closure is secured to only a small portion of the container body, the remainder of the periphery of the closure must be sealed by a bead of plastic sealing material. This increases cost and is potential source of failure of the closure.

Various other closures are disclosed in U.S. Pat. Nos. 3,250,426; 3,472,415; 3,871,552; 3,887,105 and 3,889,842. Each of the closures is complex requiring a separately attached tab or separately applied seal which increases the cost of manufacture of the container closure.

SUMMARY OF THE INVENTION

The present invention provides a closure for containers which is unitary in that no separate tab or other removal device is involved. All functional parts of the closure are formed in the metal end for the container prior to being affixed to the container body. There is neither provision for nor need for entirely removing any portion of the closure.

The closure comprises two portions formed in the container end, an activator and a lid. The lid is formed adjacent the activator and is defined by a frangible score line extending along the marginal edges of the lid. The two portions are connected together and have a fulcrum at the location of connection such that application of downward pressure on the activator causes the lid to sever at the score line and pivot upwardly from the container end about the fulcrum. The activator and lid are preferrably integral parts of the container end.

The lid is generally circular and the score line is formed on the underside of the lid, extending arcuately from one side of the fulcrum and terminating at the other side of the fulcrum. Due to the construction of the closure, downward pressure on the activator causes the score line to commence severing at a midpoint of the score line at the greatest distance from the activator. The severing thereafter continues progressively from the midpoint along the score line to its termination at either side of the fulcrum.

In order to strengthen the container end at the fulcrum, it is stiffened to assist the fulcrumming function. Stiffening preferrably comprises a pair of beads formed in the container at opposite sides of the fulcrum.

The activator comprises a raised button formed in the container end. The button includes a hinge and an inclined pressure segment extending downwardly from the hinge to the connection between the button and the lid.

In one embodiment of the invention, the lid is generally circular and includes a ridge extending about the marginal edges of the lid. The ridge extends from either side of the fulcrum and rises in an inclined fashion from the fulcrum to a point of maximum height at the greatest lateral distance from the activator. The score line is formed on the underside of the ridge on a slope thereof.

In another embodiment of the invention, the lid is generally circular and is depressed in a concave fashion from the container end. The score line is formed on the underside of the lid on a slope of the concave lid.

The fulcrum comprises an integral hinge means which permits the lid to be pivoted about the fulcrum, and in the fully opened position, positioned against and coextensive with the activator. Since the lid opens upwardly, no portion of the closure of the invention is introduced into the interior of the container, and the possibility of contamination of the container contents is greatly lessened.

BRIEF DISCRIPTION OF THE DRAWINGS

The invention is described in greater detail in the following description of the preferred embodiments, taken in conjuction with the drawings, in which:

FIG. 1 is a top plan view of a first embodiment of a container end according to the invention, FIG. 2 is a cross-sectional illustration taken along lines 2—2 of FIG. 1, FIG. 3 is a cross-sectional illustration taken along lines 3—3 of FIG. 1, FIG. 4 is a cross-sectional illustration taken along lines 4—4 of FIG. 1, FIGS. 5 through 8 illustrate progressive steps of opening the closure of the container end illustrated in FIG. 1, FIG. 9 is a top plan view of a second embodiment of a container end according to the invention, FIG. 10 is a cross-sectional illustration taken along lines 10—10 of FIG. 9, FIG. 11 is a cross-sectional illustration taken along lines 11—11 of FIG. 9, FIG. 12 is a cross-sectional illustration taken along lines 12—12 of FIG. 9, and FIGS. 13 through 16 illustrate the progressive steps of opening the closure of the container end illustrated in FIG. 9.

DESCRIPTION OF THE PREFERRED EMBODIMENTS

Figure 1:
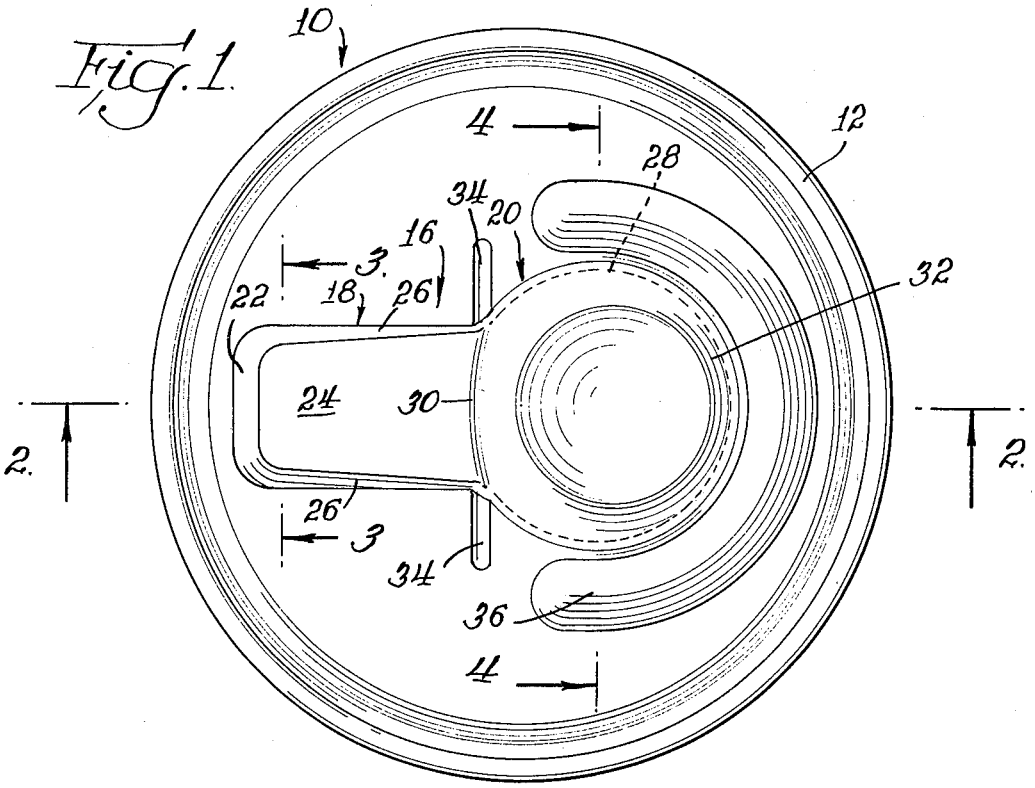

Two embodiments of a container end having a closure according to the invention are illustrated in the drawings. One form of the invention is illustrated in FIGS. 1 through 8 and another form is illustrated in FIGS. 9 through 16. Where like elements are found in the two embodiments, the drawing Figures bear the same reference numerals, it being understood that the description of various like elements in connection with one embodiment of the invention is equally applicable to the other embodiment of the invention.

Turning first to the embodiment of FIGS. 1 through 8, a container end 10 according to the invention is shown attached at its periphery 12 to a container body 14. The means of attachment of the container end 10 to the container body 14 is conventional and forms no part of the invention.

The container end 10 includes a closure 16 composed of two basic components, an activator 18 and lid 20. The components 18 and 20 are integral parts of the container end 10, and are joined as shown.

Figure 3:
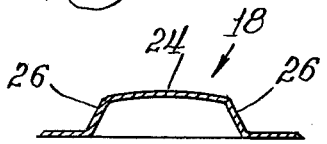

The activator 18 comprises a raised button formed in the container end 10. The button includes a raised hinge 22 and an inclined pressure segment 24 extending downwardly from the hinge 22 toward the lid 20. As best shown in FIG. 3, the sides 26 of the activator 18 adjacent the pressure segment 24 are sloped outwardly slightly to aid the operational features of the activator 18, as described in greater detail below conjunction with FIGS. 5 through 8.

Figure 2:
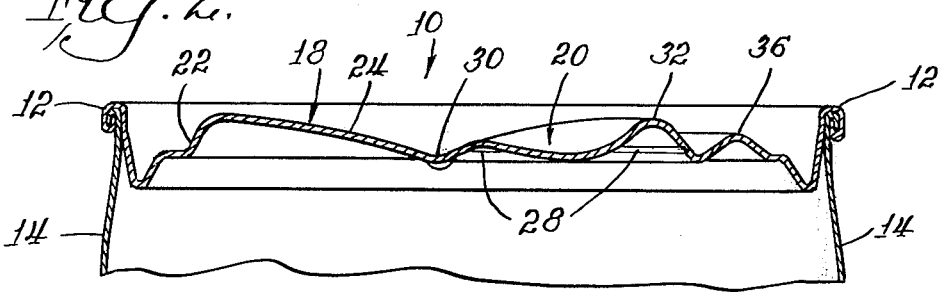
Figure 4:
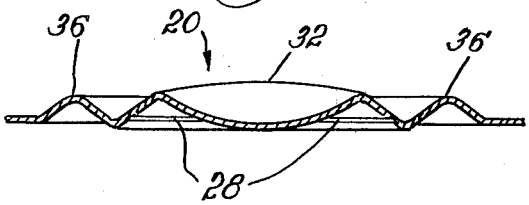

The lid 20 is generally circular and is defined by a frangible score line 28 extending along the marginal edges of the lid 20. As best shown in FIGS. 2 and 4, the score line 28 is formed on the underside of the lid 20 and extends arcuately from one side of the juncture 30 of the activator 18 and lid 20 and terminates at the other side of the juncture 30.

In the embodiment illustrated in FIGS. 1 through 8, the lid includes a ridge 32 extending about the marginal edges thereof. The ridge 32 extends from either side of the juncture 30 and rises in an inclined fashion to a point of maximum height at the greatest lateral distance from the activator 18. The score line 28 is formed on the underside of the ridge 32 on a slope thereof, adjacent the base of the ridge 32. The ridge 32 stiffens the lid 20 and serves to transmit force applied to the activator 18 to open the lid 20 along the scope line 28.

The activator 18 and lid 20 are aligned longitudinally in the container end 10. The juncture 30 lies transversely to the activator 18 and lid 20, forming a fulcrum between the two components.

Figure 5:
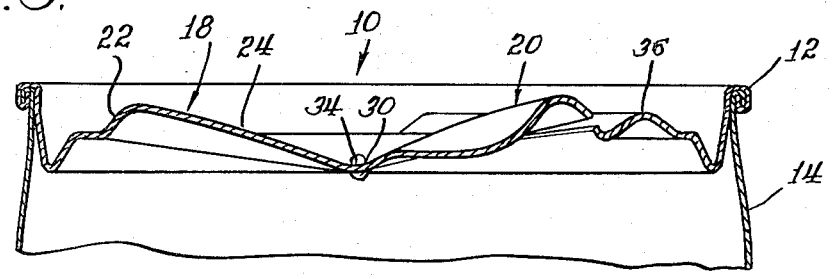
Figure 6:
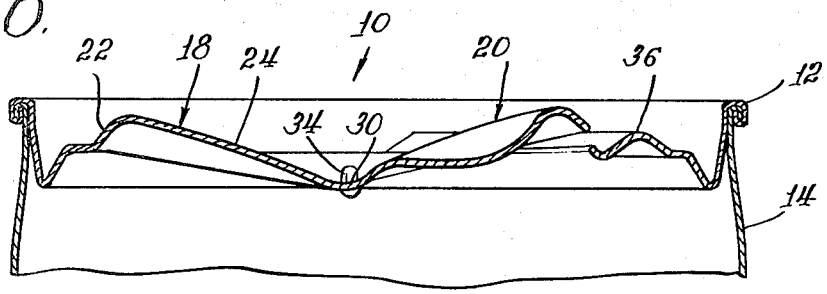
Figure 7:
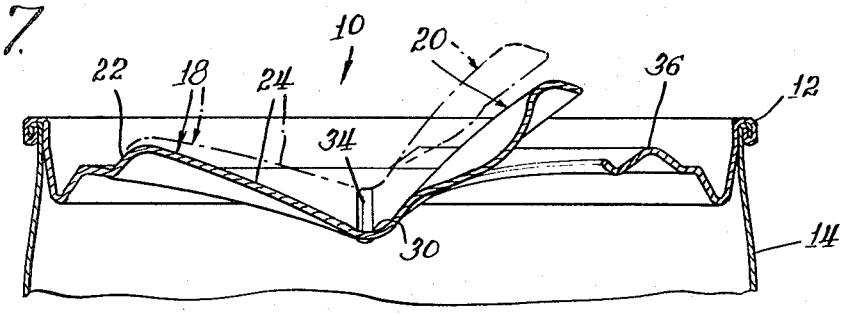
Figure 8:
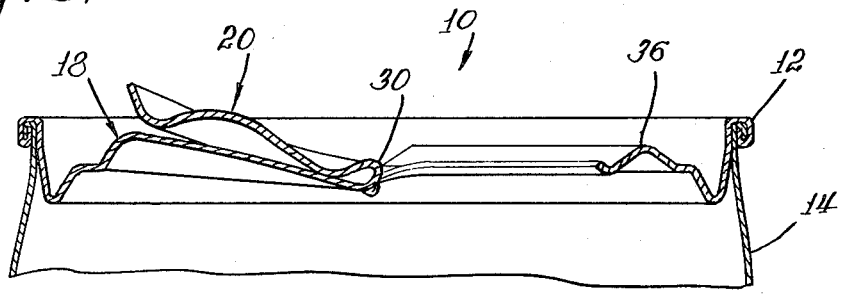
Figure 9:
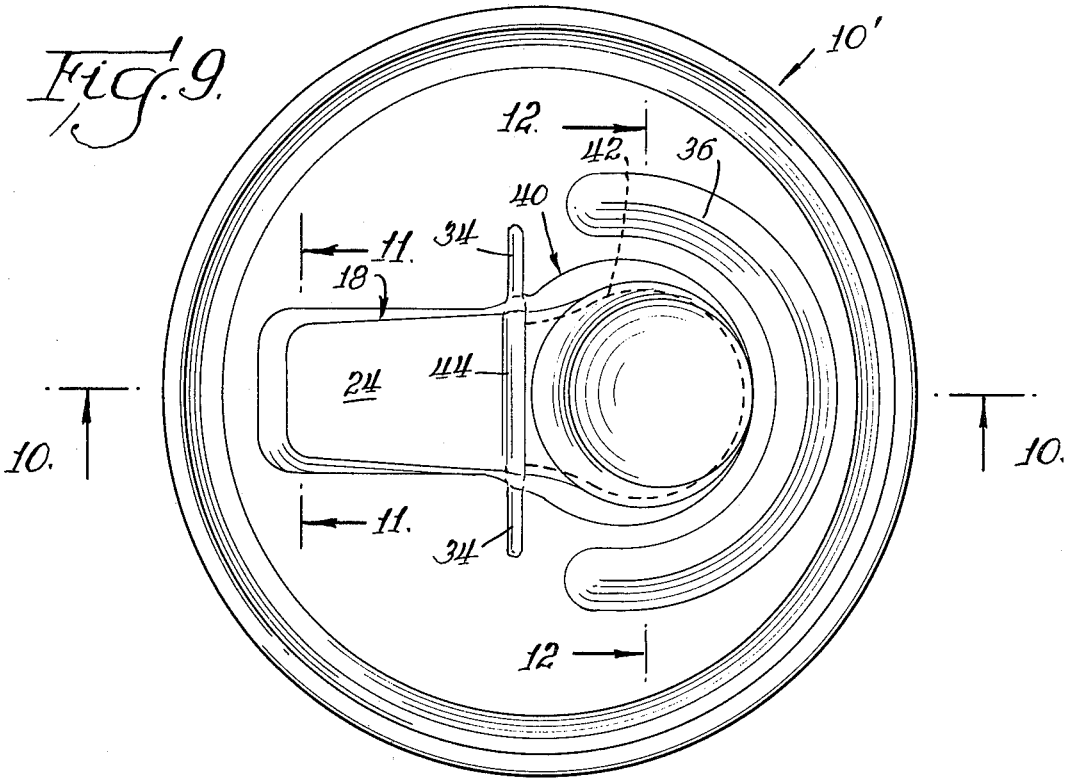
Figure 10:
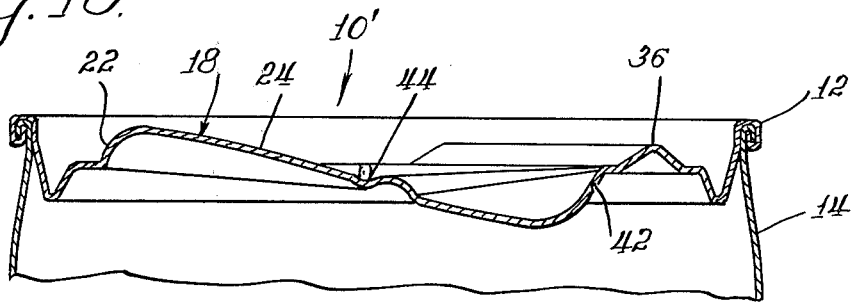
Figure 11:
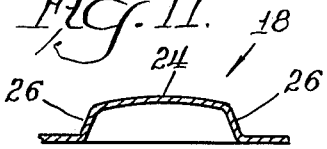
Figure 12:
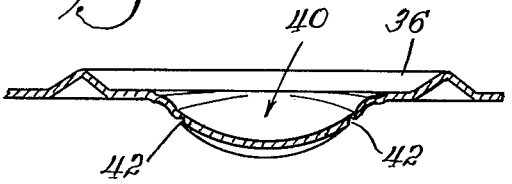
Figure 13:
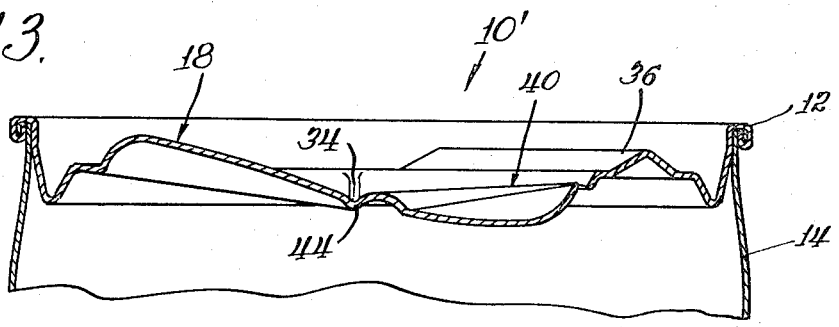
Figure 14:
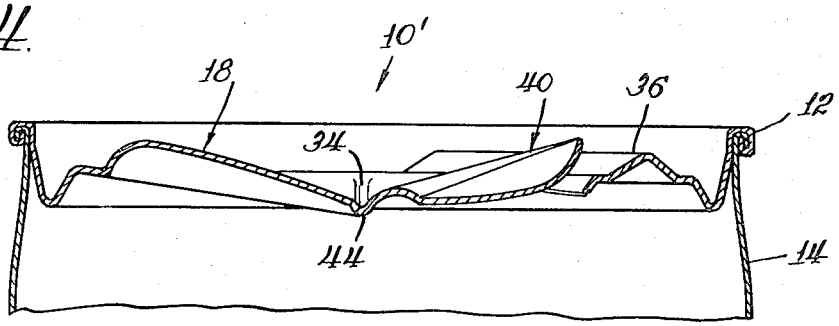

The fulcrum of the juncture 30 transmits force applied to the activator 18. Downward pressure on the activator 18 causes the lid 20 to sever at the score line 28 and pivot upwardly from the container end 18 about the juncture 30. Initial application of downward pressure on the inclined pressure segment 24 causes the score line 28 to commence severing at a midpoint of the score line 28 at the greatest distance from the activator 18, as shown in FIG. 5. As pressure continues to be applied to the pressure segment 24, the fulcrumming action of the juncture 30 raises the lid 20 and continues the severing along the score line 28 progressively from the midpoint along the remainder of the score line 28 until the score line is completely severed to the juncture 30. These progressive steps are illustrated in FIGS. 5 through 7. Then, when pressure on the pressure segment 24 is released, the inherent resilient nature of the metal of the container end 10 causes the partially opened closure 16 to spring back to the location illustrated in phantom in FIG. 7. Thereafter, with the lid 20 raised sufficiently, the user can simply apply pressure to the lid 20 to bend the lid along the juncture 30 until the lid lies contiguous to and coextensive with the pressure segment 24 of the activator 18. As can be seen from the depiction of the progressive steps of opening of the closure 16 shown in FIGS. 5 through 8, the activator 18 rotates downwardly about the hinge 22, the resiliency of the metal of the container end 10 and the sloping nature of the sides 26 permittng the depression of the activator to its greatest extent shown in FIG. 7. At the same time, the fulcrumming action of the juncture 30 transmits the downward displacement of the activator 18 into an upward force on the lid 20, the greatest upward force being experienced at the greatest distance from the activator 18. Thus, initial severing of the score line 28 necessarily commences at the greatest distance from the activator 18.

A container end of the nature of the invention is typically formed from aluminum, which, in the gages normally used for container ends, is fairly flexible. In order to stiffen the container end 10 to permit proper cofunctioning of the activator 18 and lid 20, the container end 10 includes a pair of raised stiffening beads 34 formed on opposite sides of the juncture 30. In addition, a curved strengthening rib 36 is formed contiguous to the outer margin of the lid 20.

In the second embodiment of the invention illustrated in FIGS. 9 through 16, a modified container end 10′ is illustrated. The activator 18, beads 34 and strengthening rib 36 are identical to corresponding elements shown and described in connection with FIGS. 1 through 8, and are therefore not described in further detail.

In this embodiment, a lid 40 is generally circular and is depressed in a concave fashion in the container end 10. In a similar fashion to the prior embodiment of FIGS. 1 through 8, a score line 42 is formed on the underside of the lid 40 on a slope thereof. The score line 42 extends from the juncture 44 of the activation portion 18 and the lid 40.

In the same fashion as the juncture 30 described above, the juncture 44 serves as a fulcrum to transmit application of downward pressure on the activator 18 to upward pressure on the lid 40. The juncture 44 also serves as a hinge which permits the lid 40 to be pivoted about the juncture 44.

Figure 15:
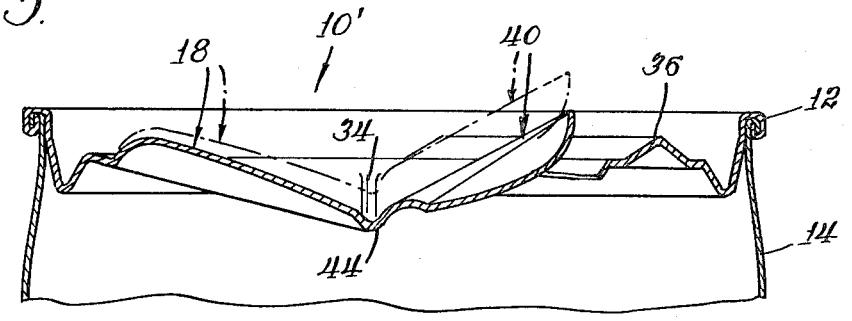

As shown in FIGS. 13 through 16, downward pressure exerted on the activator 18 causes severing of the score line 42 and raising of the lid 40 to the position shown in bold fashion in FIG. 15. Thereafter, when pressure is released from the activator 18, the resilient nature of the material of the container end 10' causes the activation portion 18 and attached lid 40 to spring back to the position shown in phantom in FIG. 15. Then, if necessary, the user can manually bend the lid 40 backward against the activator 18, out of interference with removal of the contents from the container body 14.

Figure 16:
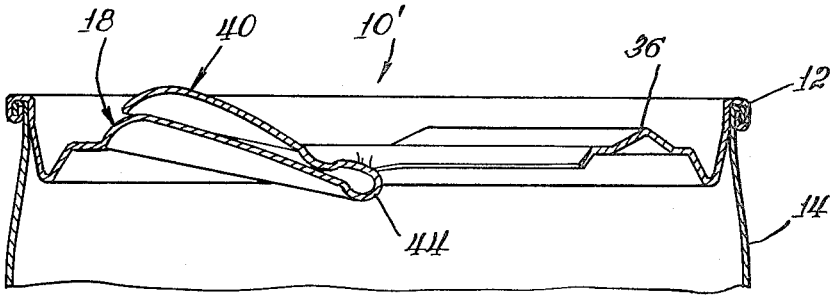

The concave nature of the lid 40 of the embodiment of FIGS. 9 through 16 provides that any sharp edges of the severed score line 42 rest against the activator 18 when the closure is fully opened to the position shown in FIG. 16. Thus, if any part of the severed score line 42 is sharp, the user will not contact it.

Various changes may be made to the invention without departing from the spirit thereof or scope of the following claims.

What is claimed is:

1. A container end which is shaped to be attached at its periphery to a container body, said container end having a closure comprising:

a. an activator formed in the container end, b. a lid formed in the container end adjacent said activator, said lid being defined by a frangible score line extending along the marginal edges of said lid, and c. means connecting said activator to said lid, said connecting means including fulcrum means operable such that application of downward pressure on said activator causes said lid to sever at said score line and pivot upwardly from said container end about said fulcrum means.

2. A container end according to claim 1 in which said activator and lid are integral parts of said container end.

3. A container end according to claim 1 in which said lid is generally circular and said score line is formed on the underside of said lid extending arcuately from one side of said fulcrum means and terminating at the other side of said fulcrum means.

4. A container end according to claim 3 in which application of downward pressure on said activator causes said score line to commence severing at a midpoint of said score line at the greatest distance from said activator, the severing thereafter continuing progressively from said midpoint along said score line to said fulcrum means.

5. A container end according to claim 1 including means stiffening said container end at said fulcrum means.

6. A container end according to claim 5 in which said stiffening means comprises beads formed in said container end at opposite sides of said fulcrum means.

7. A container end according to claim 1 in which said activator and lid are aligned longitudinally and said fulcrum means extends transversely to said activator and lid.

8. A container end according to claim 1 in which said activator comprises a raised button formed in said container end.

9. A container end according to claim 8 in which said button includes a raised hinge and an inclined pressure segment extending downwardly from said hinge to said connecting means.

10. A container end according to claim 1 in which said lid is generally circular and includes a ridge extending about the marginal edges thereof.

11. A container end according to claim 10 in which said ridge extends from said fulcrum means and rises in an inclined fashion from said fulcrum means to a point of maximum height at the greatest lateral distance from said activator.

12. A container end according to claim 10 in which said score line is formed on the underside of said ridge on a slope thereof.

13. A container end according to claim 1 in which said lid is generally circular and is depressed in a concave fashion from said container end.

14. A container end according to claim 13 in which said score line is formed on the underside of said lid on a slope thereof.

15. A container end according to claim 1 in which said fulcrum means comprises integral hinge means permitting said lid to be pivoted about said fulcrum means and positioned against and coextensive with said activator.

16. A container end shaped to be attached at its periphery to a container body and having a closure comprising:

a. a lid formed in the container end, said lid being defined by a frangible score line extending along the marginal edges of said lid on the underside of said container end, b. an activator formed in the container end and joined to said lid, said activator comprising a raised button, and c. fulcrum means at the juncture of said lid and activator, said fulcrum means i. being operable such that application of downward pressure on said activator causes said lid to sever at said score line and pivot upwardly from said container end, and ii. comprising integral hinge means permitting said lid to be pivoted about said fulcrum means and positioned coextensive with said activator.

17. A container end according to claim 16 in which said activator and lid are aligned longitudinally and said fulcrum means extends transversely to said portions.

18. A container end according to claim 16 in which said lid is generally circular and includes a ridge extending about the marginal edges thereof.

19. A container end according to claim 18 in which said score line is formed on the underside of said ridge on a slope thereof.

20. A container end according to claim 16 in which said lid is generally circular and is depresed in a concave fashion from said container end.

21. A container end according to claim 20 in which said score line is formed on the underside of said lid on a slope thereof.

* * * * *